US006491172B2

(12) United States Patent
Chance et al.

(10) Patent No.: US 6,491,172 B2
(45) Date of Patent: Dec. 10, 2002

(54) MERCHANDISING PANEL DISPLAY SYSTEM

(75) Inventors: Kenneth R. Chance, Canton, OH (US); Randy Breyer, Dover, OH (US); Peter Byar, Willingboro, NJ (US)

(73) Assignee: Commercial and Architectural Products, Inc., Dover, OH (US)

( * ) Notice: Subject to any disclaimer, the term of this patent is extended or adjusted under 35 U.S.C. 154(b) by 0 days.

(21) Appl. No.: 09/815,525

(22) Filed: Mar. 23, 2001

(65) Prior Publication Data

US 2001/0047971 A1 Dec. 6, 2001

Related U.S. Application Data

(60) Provisional application No. 60/192,145, filed on Mar. 24, 2000.

(51) Int. Cl.[7] ..... A47F 5/00

(52) U.S. Cl. ..... 211/87.01; 211/94.01; 211/57.01; 248/222.51; 248/223.41

(58) Field of Search ..... 211/87.01, 94.01, 211/57.01, 59.01; 52/27, 36.4, 36.5; 248/222.51, 223.41

(56) References Cited

U.S. PATENT DOCUMENTS

| | | | | |
|---|---|---|---|---|
| 3,256,667 | A | 6/1966 | Jungbluth et al. | 52/497 |
| 4,094,415 | A | 6/1978 | Larson | 211/57.1 |
| 4,509,648 | A | 4/1985 | Govang et al. | 211/70.6 |
| 4,615,448 | A | 10/1986 | Johnstonbaugh | 211/94 |
| 4,629,076 | A | 12/1986 | Amstutz et al. | 211/94 |
| 5,018,323 | A | 5/1991 | Clausen | 52/36 |
| 5,101,989 | A | 4/1992 | Jones | 211/94 |
| 5,109,992 | A | 5/1992 | Miller | 211/59.1 |
| 5,138,803 | A | 8/1992 | Grossen | 52/36 |
| 5,224,610 | A | 7/1993 | Vaezey | 211/87 |
| 5,379,976 | A | 1/1995 | DeGirolamo | 248/221.2 |
| 5,398,468 | A | 3/1995 | Erickson | 52/282.3 |
| 5,582,376 | A | 12/1996 | Thompson | 248/214 |
| 5,624,168 | A | 4/1997 | Licciardello, Sr. | 312/245 |
| D395,089 | S | 6/1998 | Current | D25/123 |
| 5,772,054 | A | 6/1998 | Potter | 211/87.01 |
| D397,803 | S | 9/1998 | Current | D25/123 |
| 5,803,274 | A | 9/1998 | Scheveloff | 211/87 |
| 5,860,257 | A | 1/1999 | Gerhaher et al. | 52/235 |
| 5,941,026 | A | 8/1999 | Eisenreich et al. | 52/36.5 |
| 5,944,203 | A | 8/1999 | Vlah et al. | 211/189 |

*Primary Examiner*—Robert W. Gibson, Jr.
(74) *Attorney, Agent, or Firm*—Pearne & Gordon LLP

(57) ABSTRACT

A merchandise display panel system includes a slatwall or wire grid wall having face openings for mounting of product displays and one or more spaced display panels in spaced and substantially parallel relationship. Mounting apparatus for removably connecting the display panels to the face openings in the slatwall or grid wall include elongated rails and bracket assemblies.

39 Claims, 12 Drawing Sheets

FIG. 17
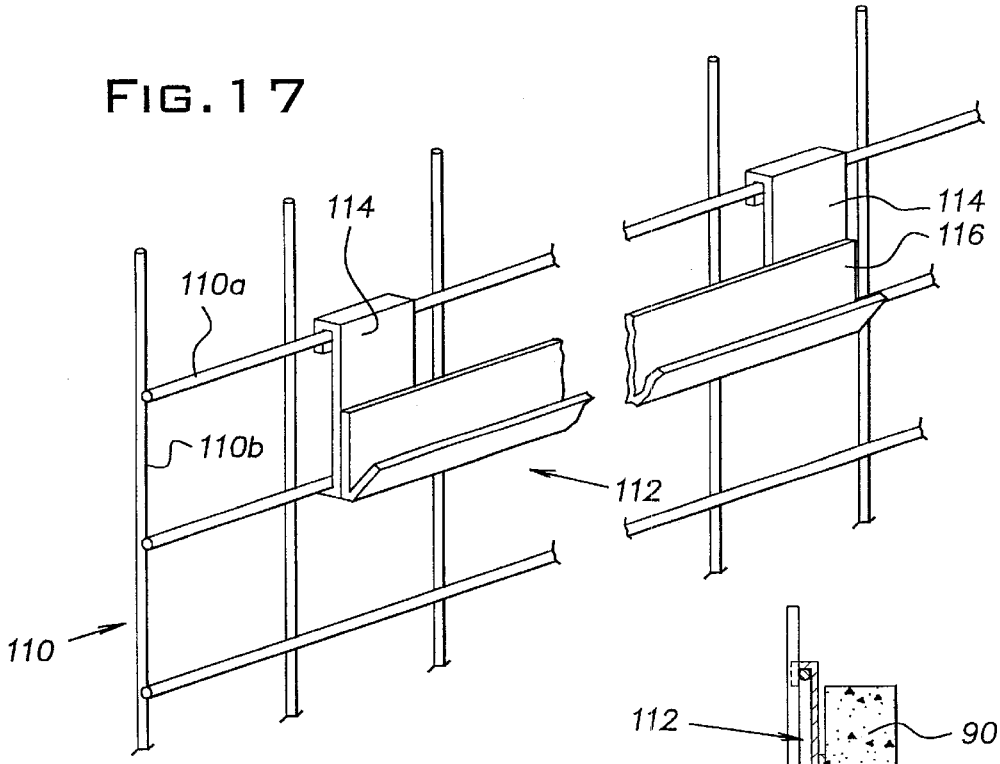
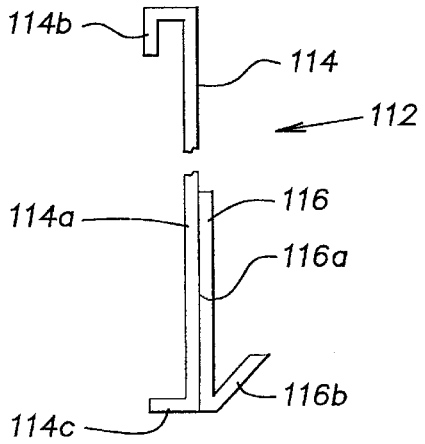
FIG. 18
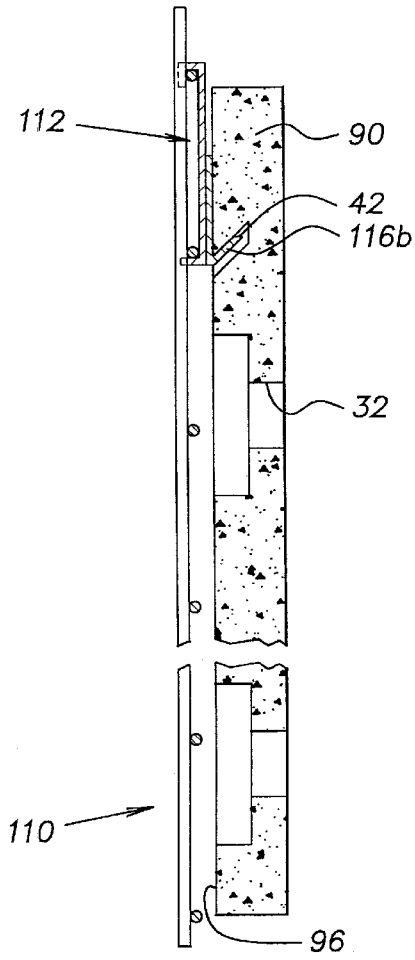
FIG. 19

MERCHANDISING PANEL DISPLAY SYSTEM

This application claims priority of U.S. Provisional Application No. 60/192,145, filed Mar. 24, 2000.

FIELD OF INVENTION

The present invention generally relates to display arrangements and, more particularly, pertains to a support system for a merchandise display panel to be included in a combined display arrangement.

BACKGROUND OF THE INVENTION

Many types of merchandise are best marketed by placing the products in a position clearly visible to the potential purchaser. Frequently, displays use slatwall to provide an array of horizontally extending grooves that receive product support hardware, such as, brackets, hangers, posts and the like as well as combinations of the same with shelves or trays. Products may be packaged in transparent plastic containers or bags to allow a purchaser to visually inspect the same when displayed with the use of such a slatwall system.

The slatwall horizontal grooves may have a cross-section of T-shape, L-shape or C-shape. In such arrangements, the grooves typically include at least one groove opening extending to the front wall. The front wall is dimensioned to cooperate with the support portion of the product support hardware to provide cantilevered support of the latter. By custom, the front wall of the groove has a thickness of about ¼", standard product support hardware is dimensioned and shaped to engage the same in order to provide cantilevered support.

Slatwall may be formed of medium density fiberboard (MDF), high density particle board (HDP), plywood and other wood-like sheet materials. The slatwall is typically provided in modular form comprising panels having a 4 foot width, an 8 foot length and a ¾ inch thickness, but other modular sizes and thicknesses may be used. Modular panels of other area sizes may be used with thicknesses ranging from ¼ inch to ⅝ inch. Reinforcing and/or decorative metal or plastic inserts may be disposed in the slatwall grooves.

The front wall or exposed slatwall face may be decorated or customized through surface applications including paint, high and low-pressure laminates, transfer foils, wood veneers and the like. The metal or plastic groove inserts may provide a color contrast with the slatwall face.

The rather permanent and non-dimensional decoration or customizing of slatwall is not entirely satisfactory or sufficient to comply with modern retailing and advertising display concepts. Slatwall does not readily lend itself to significant alteration or temporary variations of its visual appearance without substantial replacement of the modular components of the installation or parts thereof.

The display of product with conventional support or mounting hardware has been limited substantially to individual product support sites. Mounting hardware brackets including multiple hanger sites and even shelves are of a unitary product display nature as compared with the slatwall display capability in its entirety.

SUMMARY OF THE INVENTION

In accordance with the invention, a support system is used to removably mount a merchandise display panel to a support surface such as the front face of an underlying wall such as a larger size merchandise display wall. The display panel may be an aesthetic decoration or customizing element in the combined display arrangement, or it may serve to display product using the same or different types of openings as compared with the underlying wall.

The display panel is mounted to the underlying wall by support members that are constructed for connection with the same openings that are used to mount product for display. In this manner, the support members may be mounted at selected locations on the underlying wall.

In an illustrated slatwall installation, the display panel is removably mounted to the slatwall by a mounting rail engaging a panel mounting member or element. In turn, the mounting rail is removably mounted in a slatwall groove. In the mounted position, the mounting rail together with the display panel are movable relative to the slatwall.

The illustrated mounting rail comprises a metal extrusion having a Y-shape cross-section. The opposed legs of the Y provide the rail with first and second mounting legs extending in opposite transverse directions from a support leg corresponding with the stem of the Y. The rail is used in a horizontal or "laying-over" position with the mounting legs engaging the slatwall groove, and the support leg projecting from the front face of the slatwall to engage the display panel. The rear face of the display panel includes a rail engagement member. For example, the support leg end may be engaged in a kerf in the rear face of the display panel.

In another illustrated embodiment, a plurality of display panels are mounted in a stacked group. More particularly, a second display panel is mounted to a first display panel to cover the front face of the latter in whole or in part.

In another embodiment, an elongate shelf assembly enables the overlying display panels to spaced by greater distances, e.g., up to about six or seven inches. To that end, the shelf is supported by gussets arranged to work against the front face of the underlying wall.

In yet another embodiment, display panels may be mounted to a wire grid wall. In this arrangement, the support member comprises an assembly of hanging brackets connected by an elongated hook that engages the display panel over a significant portion of the panel length.

BRIEF DESCRIPTION OF THE DRAWINGS

FIG. 17 is a fragmentary perspective view of a wire grid wall having a modified mounting support in accordance with the invention;

FIG. 18 is a side view on an enlarged scale showing the mounting support of FIG. 17; and FIG. 19 is a side view of the grid wall and modified support of FIG. 17 supporting a display panel in accordance with the invention.

DETAILED DESCRIPTION OF THE DRAWINGS

Figure 1:
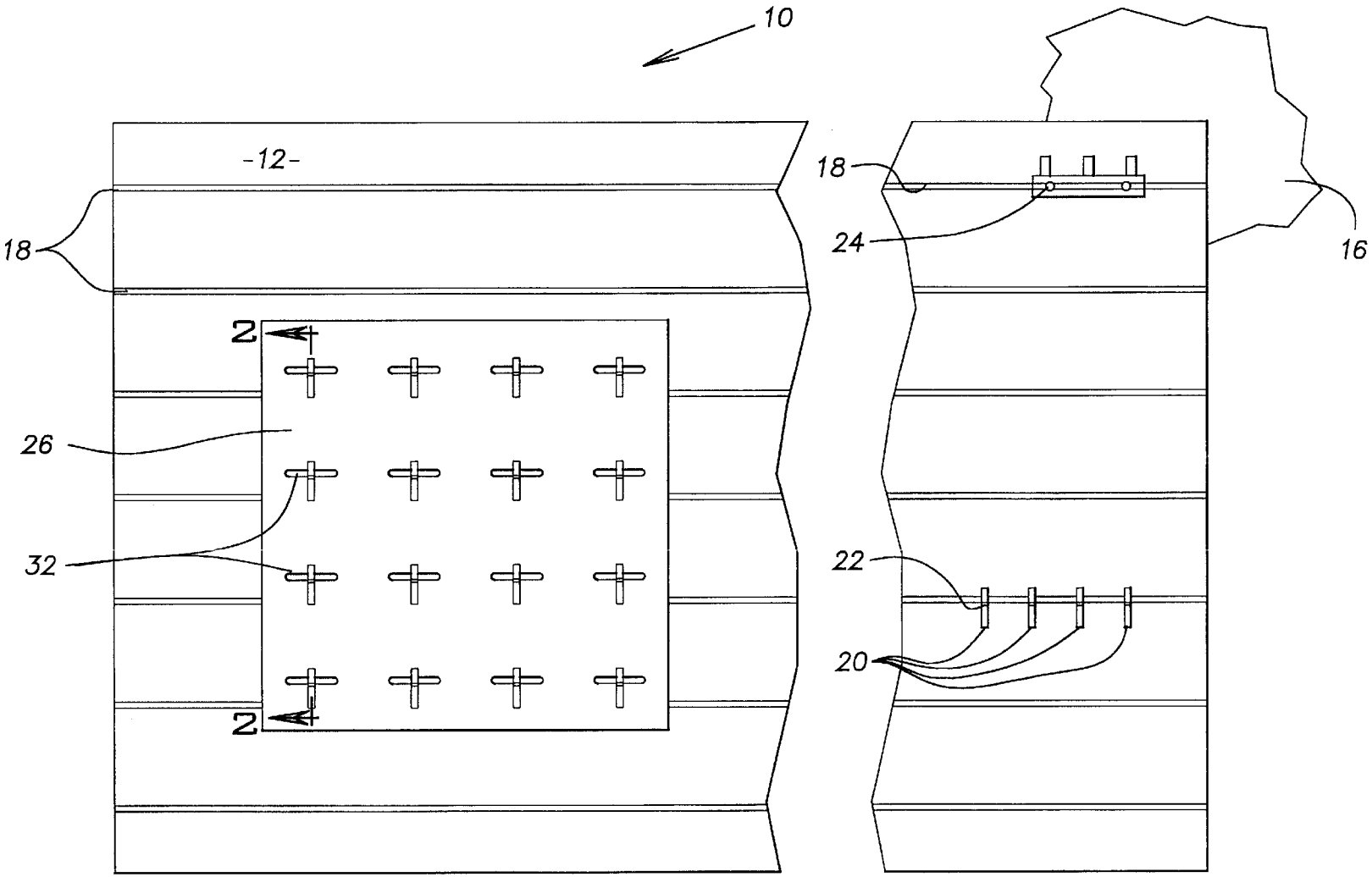
FIG. 1 is an elevational front view of a display panel mounted to a slatwall in accordance with the invention.
Figure 2:
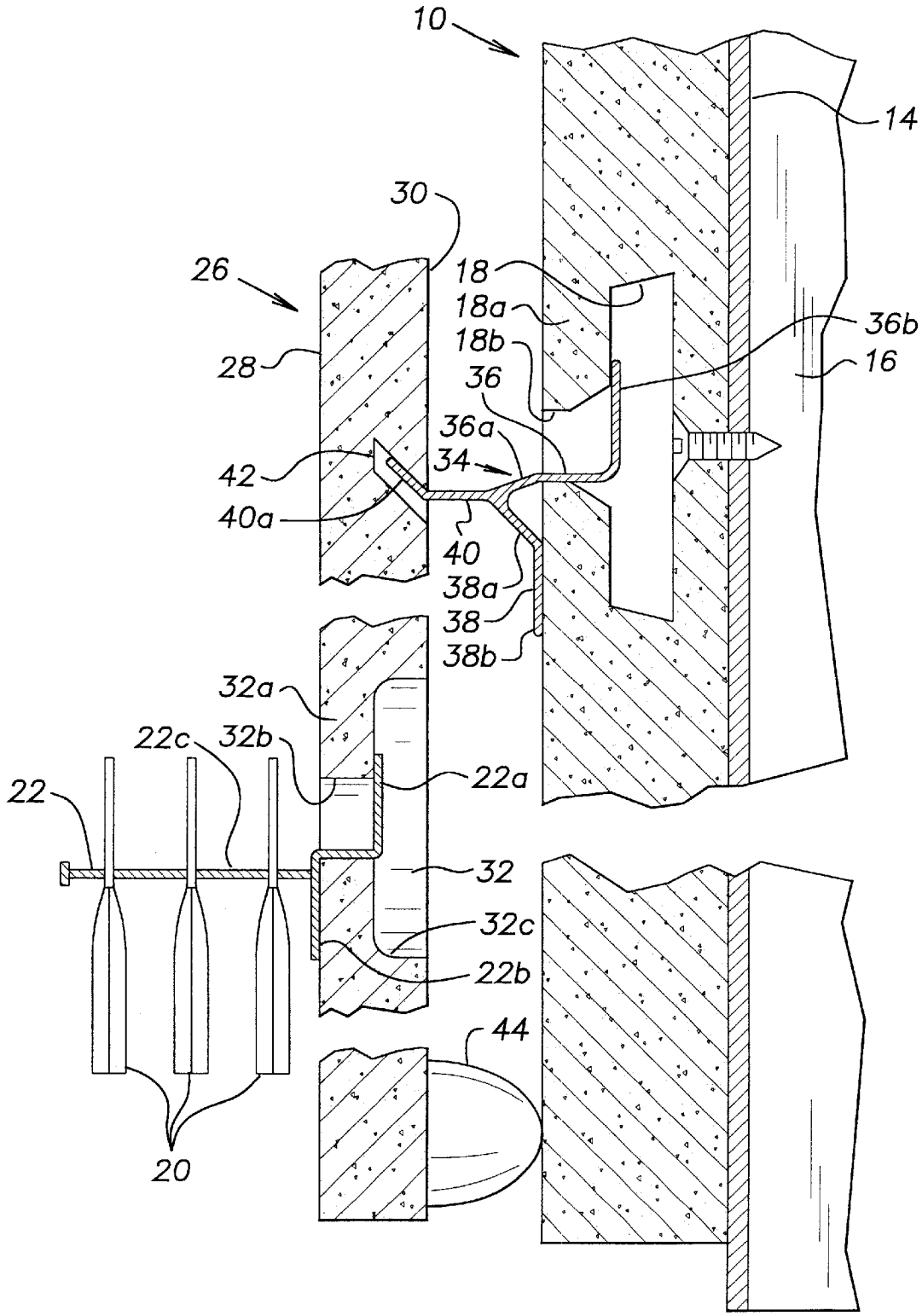
FIG. 2 is a fragmentary sectional view, on an enlarged scale, taken along the line 2—2 in FIG. 1 with parts broken away for clarity.

Referring to FIGS. 1 and 2, a slatwall 10 includes a front face 12 and a rear face 14 secured to a wall, studs, standards, posts or other support structure 16. Horizontally extending grooves 18 are provided in the front face 12 of the slatwall for supporting products 20 using conventional hardware or product supports 22 engaged within the grooves 18. (For convenience, the grooves 18 are shown with a relatively large vertical spacing, instead of the typical 3" spacing, and the drawing is not to scale.) As shown in the right hand portion of FIG. 1, the hardware 22 may comprise unitary wire-formed support brackets projecting from the face of the slatwall for hanging packaged product 20 or a combined bracket and shelf 24 for stacked product 20.

A display panel 26 extends across a portion of the front face 12 of the slatwall 10. The display panel 26 includes a front face 28 and a rear face 30. A plurality of slots or grooves 32 are provided in the front face 28 of the panel 26 for receiving conventional hardware 22 for mounting product 20. The display panel 26 itself is mounted in a groove 18 by a mounting rail 34.

Figure 3:
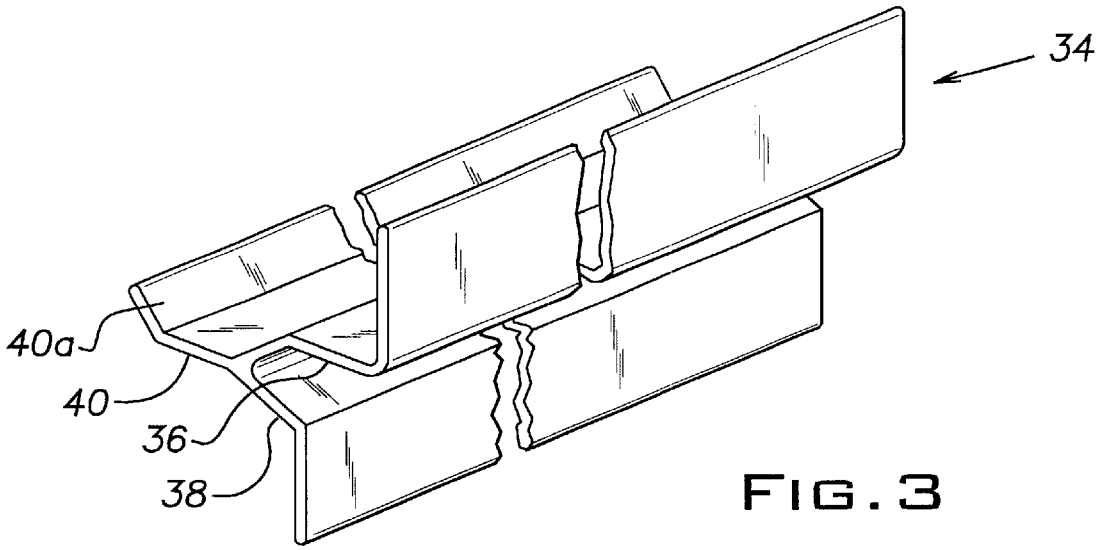
FIG. 3 is a somewhat schematic perspective view of the mounting rail with parts broken away for convenience of illustration.

Referring more particularly to FIGS. 2 and 3, the mounting rail 34 has a Y-shape cross-section and it is disposed in a horizontal or "laying over" orientation in use. The rail 34 may be formed of any material of sufficient strength and rigidity. For example, the rail may be formed of metal in any convenient manufacturing process, e.g. rolling or extrusion. Presently, the rail 34 is formed as an aluminum extrusion with a nominal thickness of 0.040".

The mounting rail 34 may be provided with a suitable architectural interior finish. For example, the surfaces of the rail 34 may be anodized, powder coated, painted or finished in some other aesthetically pleasing manner.

The rail 34 includes opposed legs 36 and 38 extending in opposite transverse directions from a mounting leg 40. The legs 36 and 38 cooperate to engage the groove 18 and provide cantilever support for the display panel 26. The groove 18 has a T-shape including a front wall 18*a* and a throat opening 18*b*. The legs 36 and 38 include angular extension portions 36*a* and 38*a* respectively terminating at working portions 36*b* and 38*b*. The working portions 36*b* and 38*b* are parallel and horizontally offset a distance substantially equal to the thickness of the front wall 18*a* of the groove 18.

As best shown in FIG. 2, the extension portion 36*a* extends through the throat opening 18*b* and the working portion 36*b* engages the rear face of the wall 18*a*. The extension portion 38*a* extends downwardly toward the slatwall 10 and the working portion 38*b* engages the front face 12 of the slatwall. It should be appreciated that the downwardly angular orientation of the extension 38*a* tends to transfer the cantilever load to the front face 12 of the slatwall and thereby reduces the load applied to the rear face of the front wall 18*a*.

The mounting leg 40 includes an angular engagement portion 40a that is received in a kerf 42 cut in the rear face 30 of the display panel 26. The engagement portion 40*a* extends upwardly at a 45 degree angle for receipt in the kerf 42, and the kerf 42 is cut at a downwardly opening 45 degree angle. This angular engagement is sufficient to inhibit any tendency of the display panel 26 to disengage from the mounting rail 34.

In order to inhibit swinging movement of the display panel 26 and further assure it's parallel relationship with the slatwall 10, a bumper 44 is fixed to each of the lower corners of the rear face 30 of the panel for engagement with the front face 12 of the slatwall. The bumper 44 may be formed of a resilient material such as rubber or plastic.

The bumper 44 is sized so that the panel 26 is parallel with the slatwall 10, and a 1" wide clearance is provided between the slatwall front face 12 and panel rear face 30. In this manner, the panel front face 28 extends in a substantially vertical plane.

Figure 4:
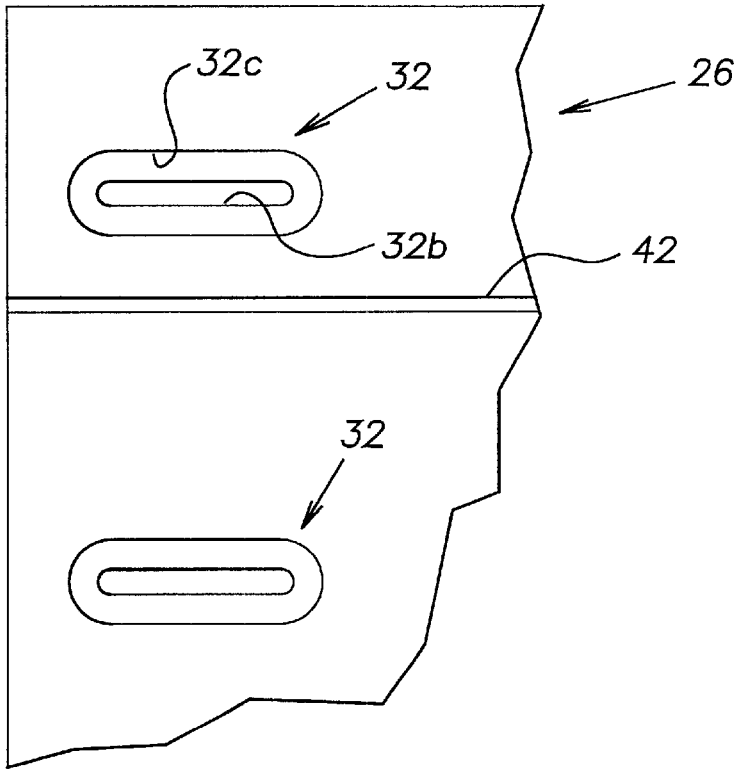
FIG. 4 is a fragmentary elevational view, on an enlarged scale, of the rear face of the display panel shown in FIG. 1.

As noted above, product 20 is mounted to display panel 26 using conventional hardware 22 such as the illustrated Z hook or bracket most clearly shown in FIG. 2. The slot 32 includes a front wall 32*a*, a slot throat 32*b* and an oval-shape recess 32*c* that opens to the rear face 30 of the panel as shown in FIG. 4. The recess 32*c* has a substantially flat bottom to provide the front wall 32*a* with a planar rear face for engagement by the hardware 22.

The depth of the recess 32*c* is selected to provide the front wall 32*a* with a suitable thickness, e.g. ¼", for engagement with standard support hardware. The slot throat 32*b* has a 3" length and it is about ⅜" wide. The recess 32*c* has a length of about 3⅞ inches and a width of about 1 5/16 inches. These dimensions accommodate most product mounting hardware, but other dimensions may be used. Accordingly, the hardware 22 works against the rear face of the front wall 32*a* and a lower leg 22*b* that engages the front face 28 of the display panel to support the product 20 hanging from a projecting support leg 22*c* in a cantilever manner.

The thickness of display panel 26 may be ½", ¾", ⅝" or some custom size selected by a particular customer. The recess depth is varied in accordance with the panel thickness to accommodate conventional hardware having a Z-type mounting portion and a ¼" offset. More particularly, the recess 32*c* cut into the back of the panel is sufficiently deep so that the remaining front wall thickness is ¼".

Referring once again to FIG. 1, the display panel 26 has a 2'×2' modular size and provides 4 row by 4 column array of slots 32. The rows of slots 32 are vertically spaced at 6" intervals and the columns of slots are horizontally spaced at 3" intervals. The mounting rail 34 is 20" long and laterally centered along the length of the kerf 42 which extends across the full width of the panel 26.

If aesthetically preferred, the rail length may be sufficiently less than the width of the display panel so that the rail ends are not visible when the panel is viewed from the front over a typical angular range of view. This is true since the slot 32 in the panel tends to fail before the rail connection between the panel 26 and slatwall 10. This order of failure is not altered by the resulting increase in load per unit length upon sufficiently shortening the rail to hide its ends from view.

For example, the 20" length of the rail 34 tends to hide its ends from view when used with the 24" wide panel 26. The 20" length remains adequate to reduce the load per unit length applied to the front wall 18*a* to avoid failure of the slatwall 10 within expected application load ranges. Similarly, the kerf 42 does not fail.

In load tests, the merchandising panel 26 formed of medium density fiberboard tends to be the weak point and break. Using a 2'×2' panel, supported product weight or break loads range from 15 to 39 pounds. (In these tests, increasing hanging weights are applied to the product support 22 at three day intervals until failure occurs.) The break or failure tends to depend upon the composition of the merchandising panel board. The slatwall groove 18 and kerf 42 typically do not break, the panel slot 32 tends to fail first. That is, the hardware 22 "breaks-out" the slot 32 including the front wall 32*a* when failure occurs.

Figure 5:
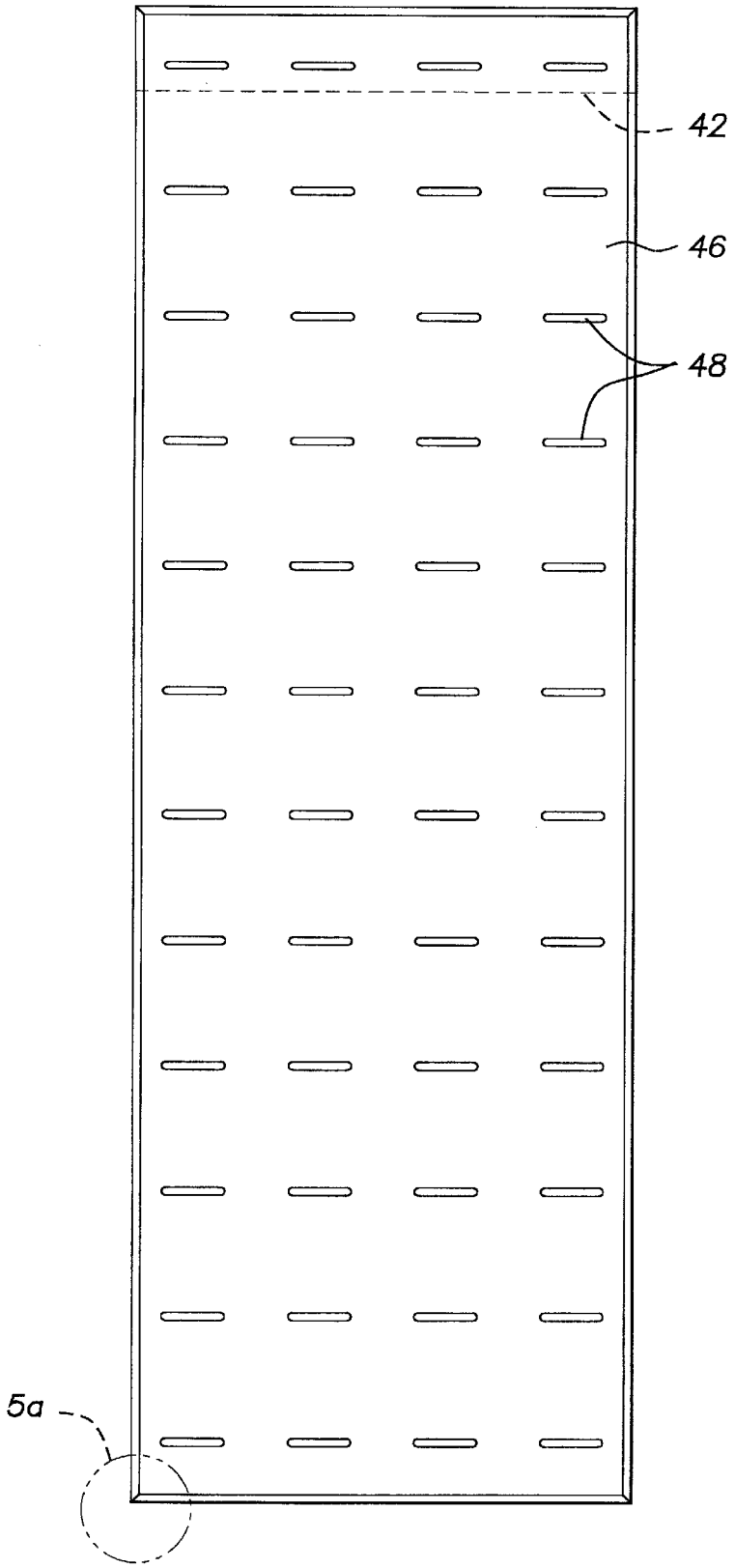
FIG. 5 is an elevational view of the front face of a display panel in accordance with another embodiment of the invention.

In the foregoing manner, the rail mounting arrangement for the display panel overcomes many of the slot and size restrictions previously observed in panel design. For example, a display panel 46 having a 2'×6' square shape and a thickness of ½", may be provided with a 12 row by 4 column array of spaced slots 48 as shown in FIG. 5. The slots 48 correspond in size and shape with the slots 32. The rows of slots 48 are about 6 inches apart and the columns are spaced at 3 inch intervals. If smaller and/or closer spacing of product is desired, an 8 row by 4 column array of slots 32 may be provided.

Of course, display panels may be provided in a variety of modular sizes and shapes including rectangular and non-rectangular. (As used herein, rectangular includes square.) For example, 2'×2', 2'×4', 4'×4', 4'×6' and 2'×6' modular sizes may be used as well as other intermediate sizes. Since slatwall is typically provided in a 4'×8' modular size, the display panel area will be equal to at least ⅛ of the area of the slatwall modular size. In this manner, the display panel provides a significantly sized display or decorative element relative to the slatwall. In each of these further arrangements, the rail 34 or similar rail of appropriate size continues to adequately support the display panel and the break or failure due to product load continues to occur at the slots.

Figure 5A:
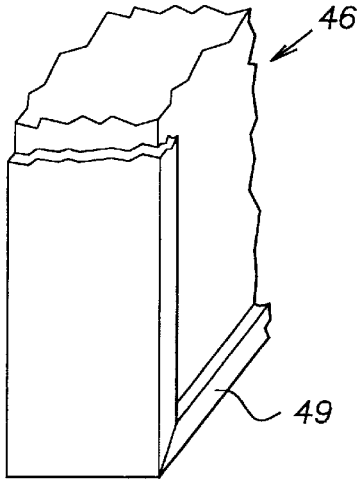
FIG. 5*a* is a fragmentary perspective view of the corner edge marked in dotted outline at 5*a* in FIG. 5.

Referring to FIG. 5*a*, edge molding or trim 49 is shown mounted about the periphery of the slatwall 46. The molding 49 closes the end of the slatwall and extends a small distance onto the front face of the slatwall to provide a finished appearance. The molding 49 may be mounted to the fiberboard of the slatwall 46 in any convenient manner such as adhesives or mechanical fasteners (not shown). The molding may be formed of metal, wood or plastic and provided with a suitable architectural interior finish. For example, the metal surfaces may be anodized, powder coated, painted or finished in some other aesthetically pleasing manner.

Figure 6:
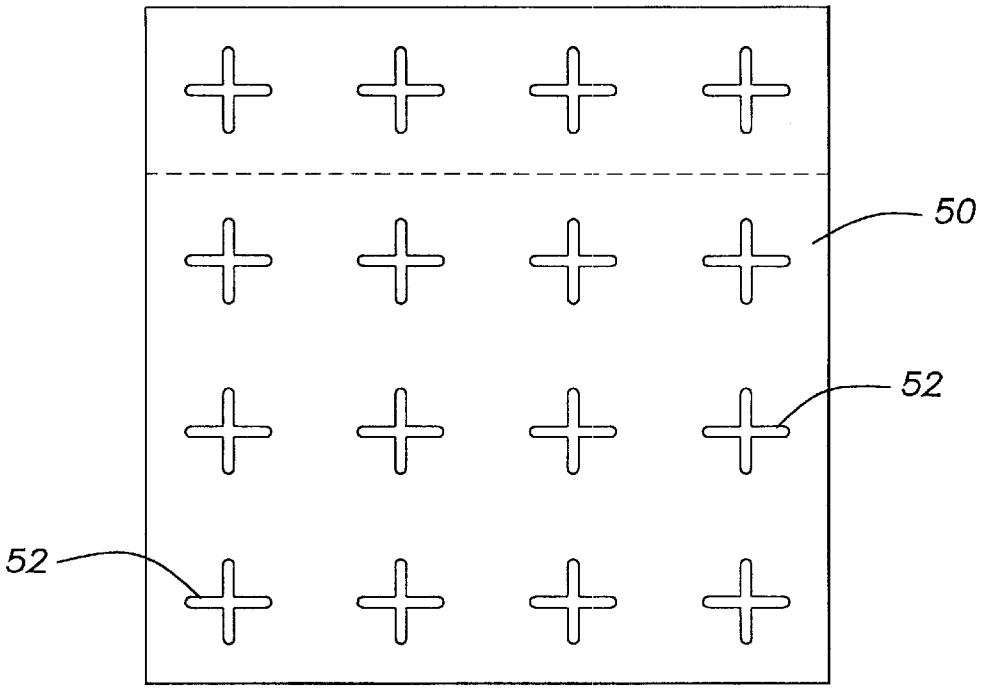
FIG. 6 is an elevational view of the front face of a display panel in accordance with yet another embodiment of the invention.
Figure 7:
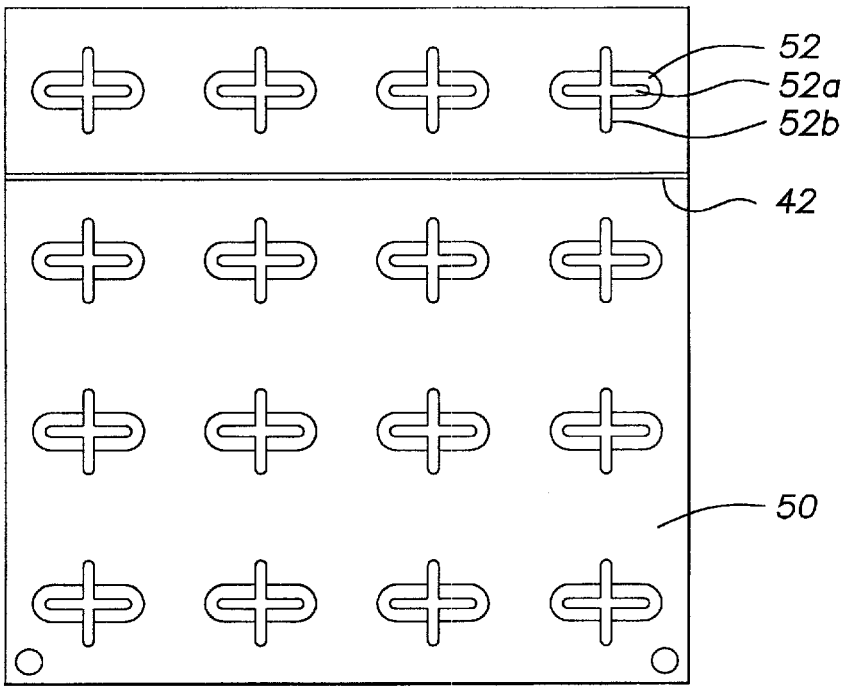
FIG. 7 is an elevational view of the rear face of the display panel shown in FIG. 6.

Referring to FIGS. 6 and 7, a display panel 50 includes cross slots 52. The cross slots 52 are arranged in a 4 row by 4 column array, and the panel 50 has a 2'×2' square shape and a ½" thickness. A kerf 42 is cut in the rear face of the panel.

As best shown in FIG. 7, each of the cross slots 52 includes a horizontal portion 52*a* substantially corresponding with the slot 32 and an intersecting vertical opening 52*b*. Accordingly, the horizontal portion 52*a* includes a throat open to the front face of the panel 50 and a recess open to the back face of the panel which cooperate to receive product support hardware 22 in the same manner as the slot 32. The slot portion 52*b* provides a decorative design feature which may be used to introduce support hardware into the slot 52.

Figure 8:
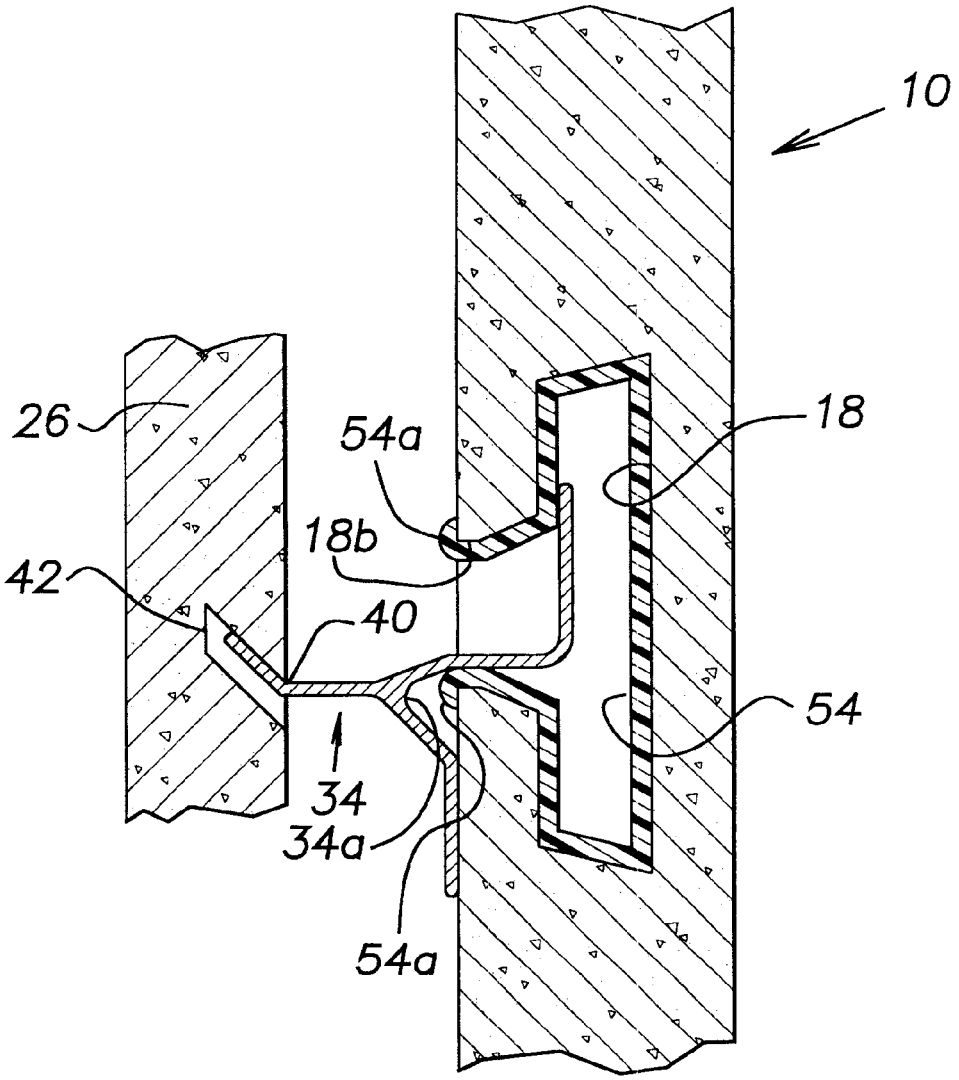
FIG. 8 is a sectional view similar to FIG. 2 showing an insert mounted in the slatwall groove of the slatwall of FIG. 1.

Referring to FIG. 8, a liner 54 is shown inserted in one of the grooves 18 of the slatwall 10. The liner 54 may be formed of a metallic material and shaped to closely correspond with the interior surfaces of the groove 18 so as to require mounting through an open end of the groove. The liner 54 may also be formed of a resilient plastic material which conforms less closely with the interior shape of the groove 18, but which may be inserted into the groove through the throat 18*b* as shown in U.S. Pat. No. 5,138,803, which is also owned by the assignee herein.

The liner 54 includes protective lips 54*a* which extend through the throat 18*b* and engage the front face 12 of the slatwall 10. The rail 34 accommodates the lower lip 54*a* within the bight of its Y-shape generally indicated at 34*a*. The thickness of the liner 54 is accommodated by a slight deflection of the rail due to the weight of the panel 26 and any product 20 mounted thereon. More particularly, any clockwise displacement of the rail 34 caused by the thickness of the liner 54 is overcome by the counter clockwise torque load applied by the weight of the display panel to the mounting leg 40 and the resulting deflection of the rail 34. In this manner, the rail 34 and the panel 26 cooperate to maintain the front face 28 of the panel in parallel relationship with the front face 12 of the slatwall 10.

Figure 9:
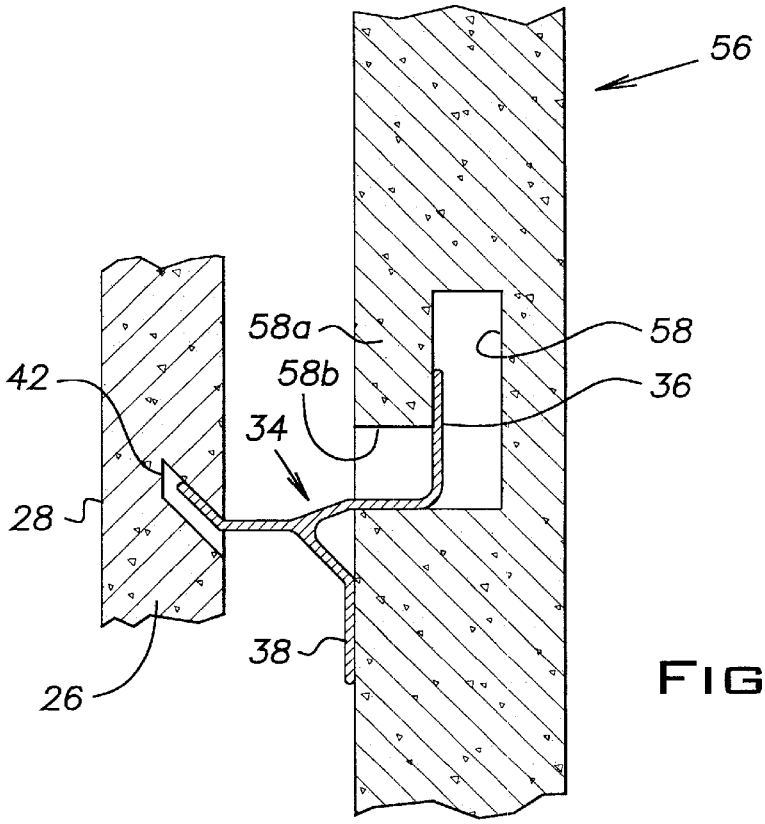
FIG. 9 is a sectional view similar to FIG. 5 showing a slatwall having an L-shaped groove supporting a display panel in accordance with another embodiment of the invention.

Referring to FIG. 9, a slatwall 56 has an L-shape groove 58 including a front wall 58*a*. The mounting rail 34 is engaged within the groove 58 for supporting the panel 26 in parallel relationship with the slatwall 56. As in the embodiment of FIG. 1, the leg 36 of the rail 34 extends through a throat opening 58*b* and works against a rear face of the front wall 58*a*. Further, the leg 38 of the rail 34 works against the front face of the slatwall 56.

Figure 10:
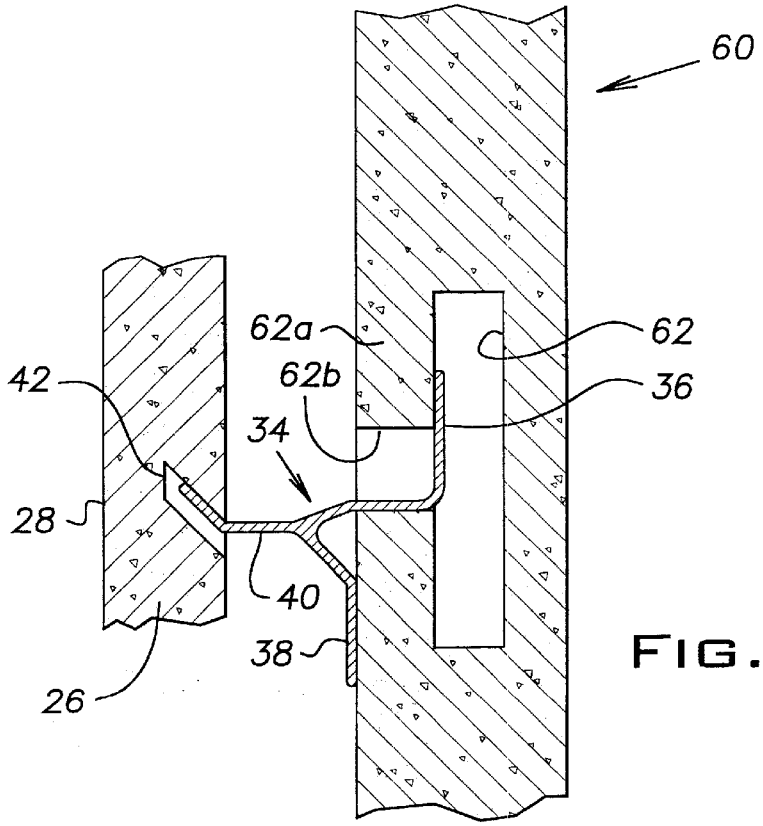
FIG. 10 is a sectional view similar to FIG. 5 showing a slatwall having an L-shaped groove supporting a display panel in accordance with another embodiment of the invention.

Referring to FIG. 10, a slatwall 60 has a rectangular C-shape groove 62 including a front wall 62*a* and a throat opening 62*b*. The mounting rail 34 is engaged within the groove 62 and supports the display panel 26 in the same manner as described above with respect to the slatwall 10. Accordingly, the legs 36, 38 and 40 of the rail 34 provide the same functions as described above.

Figure 12:
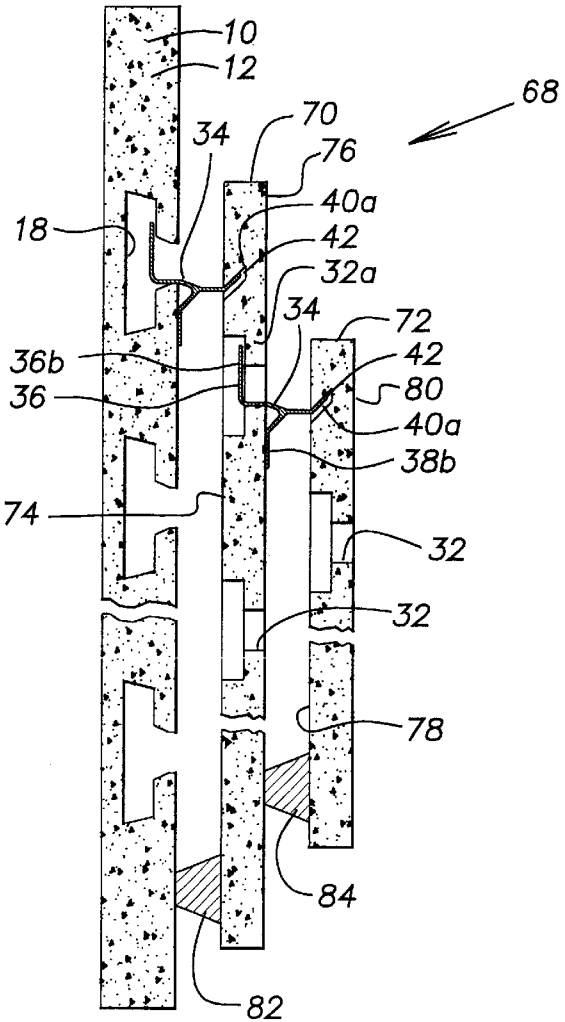
FIG. 12 is a schematic fragmentary side view on an enlarged scale of the slatwall and display panels of FIG. 11.
Figure 11:
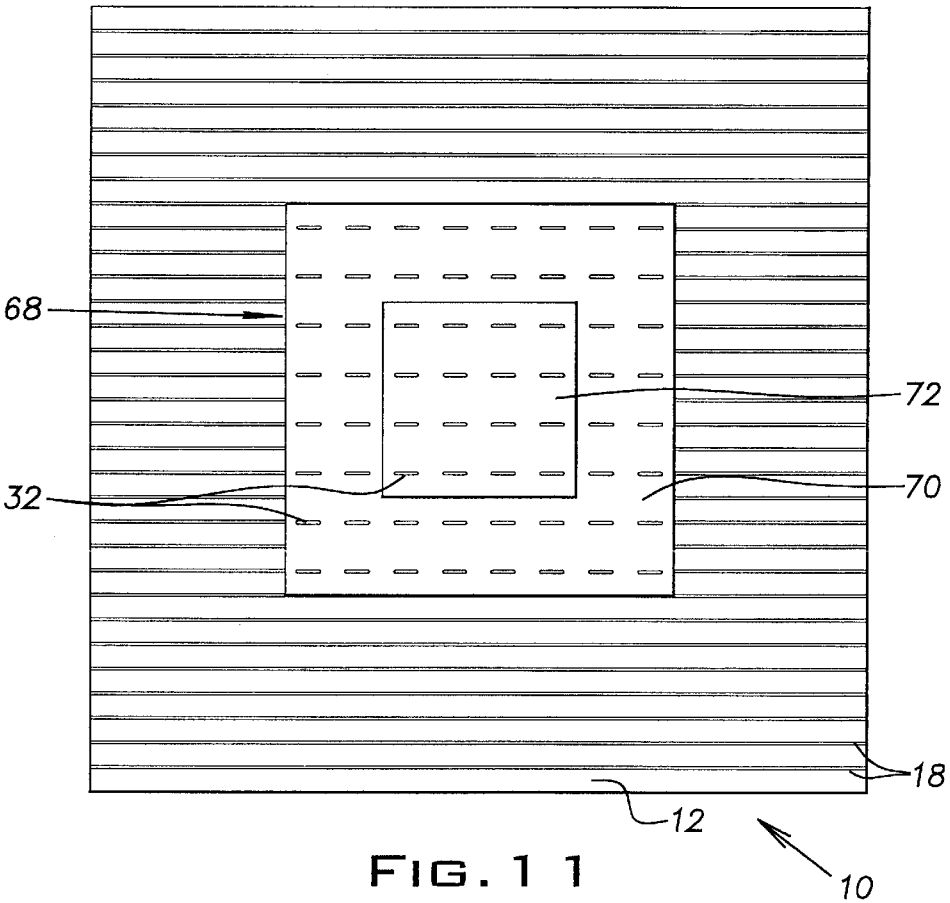
FIG. 11 is an elevational front view of a stacked group of display panels mounted to the slatwall of FIG. 1.

Referring to FIGS. 11 and 12, the slatwall 10 has a stacked panel group 68 mounted thereto. The group 68 includes a display panel 70 and an overlying display panel 72.

For purposes of displaying product, the panel 70 includes an 8 row by 8 column array of slots 32. Similarly, the display panel 72 includes a 4 row by 4 column array of slots 32.

The display panel 70 has a rear face 74 and a front face 76. The panel 70 is mounted to the slatwall 10 by a mounting rail 34 in the same manner as described above. Accordingly, a kerf may be cut in the rear face 74 of the panel 70 for receiving the engagement portion 40*a* of the rail 34.

The display panel 72 has a rear face 78 and a front face 80. The panel 72 is mounted to the panel 70 by a mounting rail 34. More particularly, the working portion 36*b* of the leg 36 of the mounting rail works against the rear face of the front wall portion 32*a* of the slot 32. The working portion 38*b* of the leg 38 of the mounting rail works against the front face 76 of the panel 70. Again, a kerf 42 may be cut in the rear face 78 of the panel 72 for receiving the engagement portion 40*a* of the rail 34. Accordingly, the display panel 72 is mounted to the panel 70 in a manner similar to that previously described.

The mounting rails 34 are respectively arranged to support the display panels 70 and 72 in a vertical orientation. The stability of this orientation is assured by the pairs of bumpers 82 and 84 respectively mounted adjacent the lower corners of the rear faces of the display panels for engagement with front face 12 of the slatwall 10 and front face 76 of the panel 70. The bumpers 82 and 84 may be formed of a rubber or plastic material similar to the bumpers 44.

The mounting rail 34 supporting the panel 70 may be provided with a length sufficiently shorter than the width of the panel so as to hide the rail ends when the panel group 68 is viewed from the front during use. The mounting rail supporting the panel 72 may be similarly sized with respect to this panel.

As shown in FIG. 11, the panels 70 and 72 are similarly shaped, each of the panels being square and respectively having a 4' by 4' module size and a 2' by 2' module size. The panels are symmetrically mounted in the sense that they have a common center point, and the periphery of the panel 72 is equally spaced from the periphery of the panel 70.

In the arrangement shown in FIG. 11, product may be mounted in the exposed slots 32 of the panel 70 located about the periphery of the panel 72. Of course, product may also be mounted in the slots 32 of the panel 72. The front faces 12, 76 and 80 of the slatwall and display panels may be of contrasting colors or surface designs.

The use of similarly shaped panels and symmetrical mounting is not necessary. Accordingly, the panels may be of different shapes and they may be mounted in non-symmetrical arrangements, e.g., the panel 72 may be mounted so as to overlie a corner quarter of the front face 76 of the panel 70.

Figure 13:
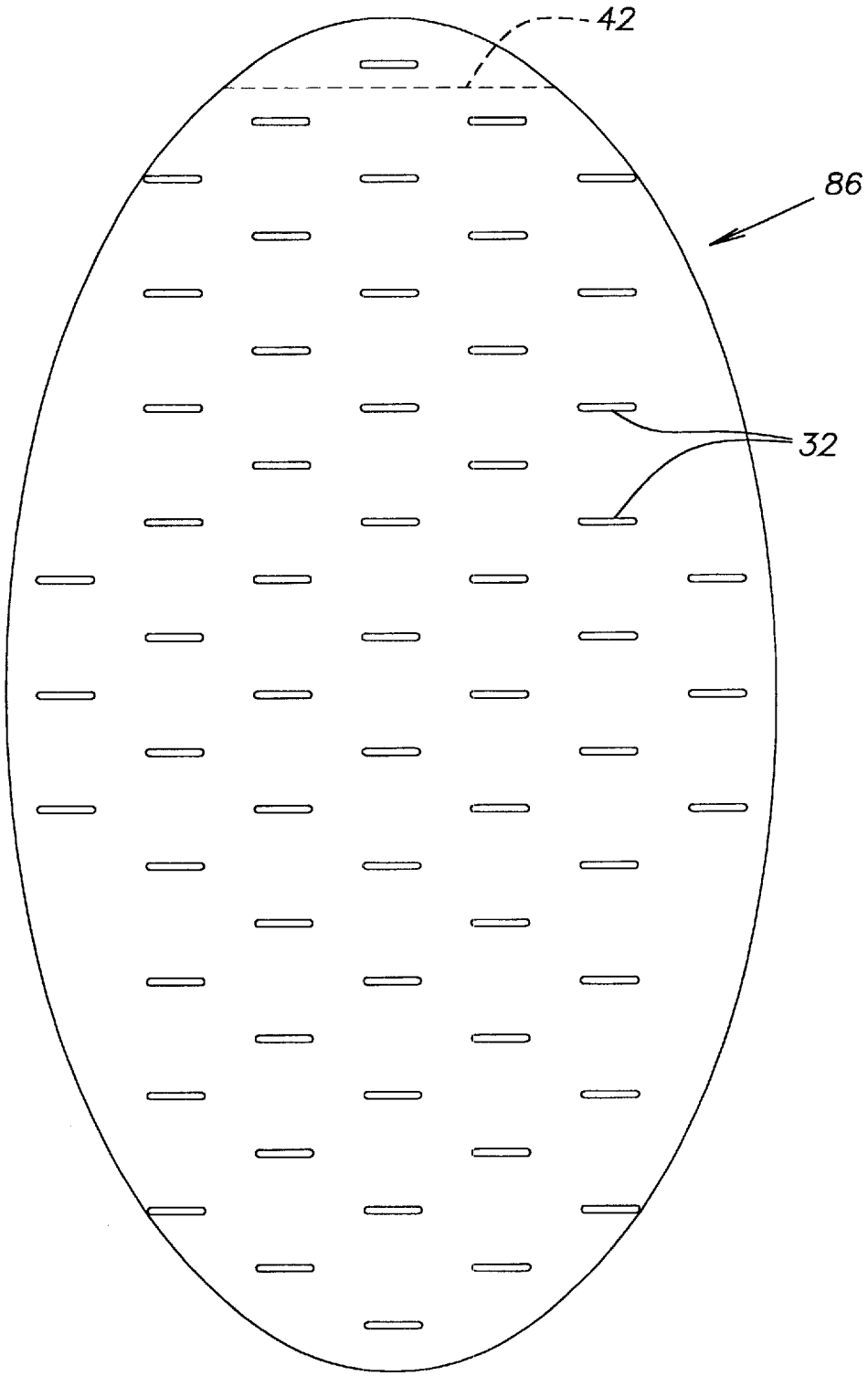
FIG. 13 is an elevational front view of a display panel in accordance with another embodiment of the invention.

Referring to FIG. 13, a display panel 86 has a plurality of spaced slots 32. As shown in dotted outline, a kerf 42 may be cut in the rear face of the panel 86. As described above, the kerf 42 is arranged to receive the engagement portion 40*a* of the mounting rail 34 for mounting the panel 86 to slatwall 10. One of more bumpers (not shown) may be provided adjacent the rear face of the panel 86 to assure its vertical orientation when mounted to the slatwall.

The panel 86 has an oval or elliptical shape with a major axis of about six feet and a minor axis of about three feet. The slots 32 are ranged in vertical columns with the slots of adjacent columns being vertically offset.

The display panel 86 may have other non-rectangular shapes, such as circular, or other geometric shapes or even irregular shapes. Similarly, the slots 32 may be arranged in various patterns or non-repeating arrangements for optimum product display or decorative appearance.

Figure 15:
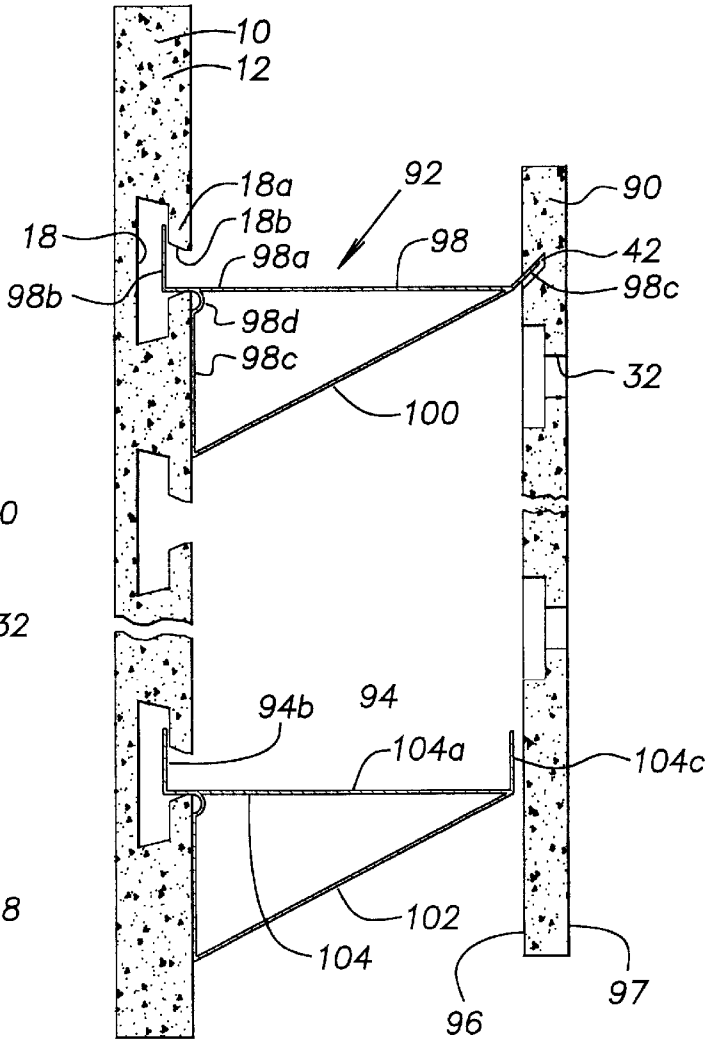
FIG. 15 is a schematic fragmentary side view on an enlarged scale of the slatwall and display panel of FIG. 14.
Figure 14:
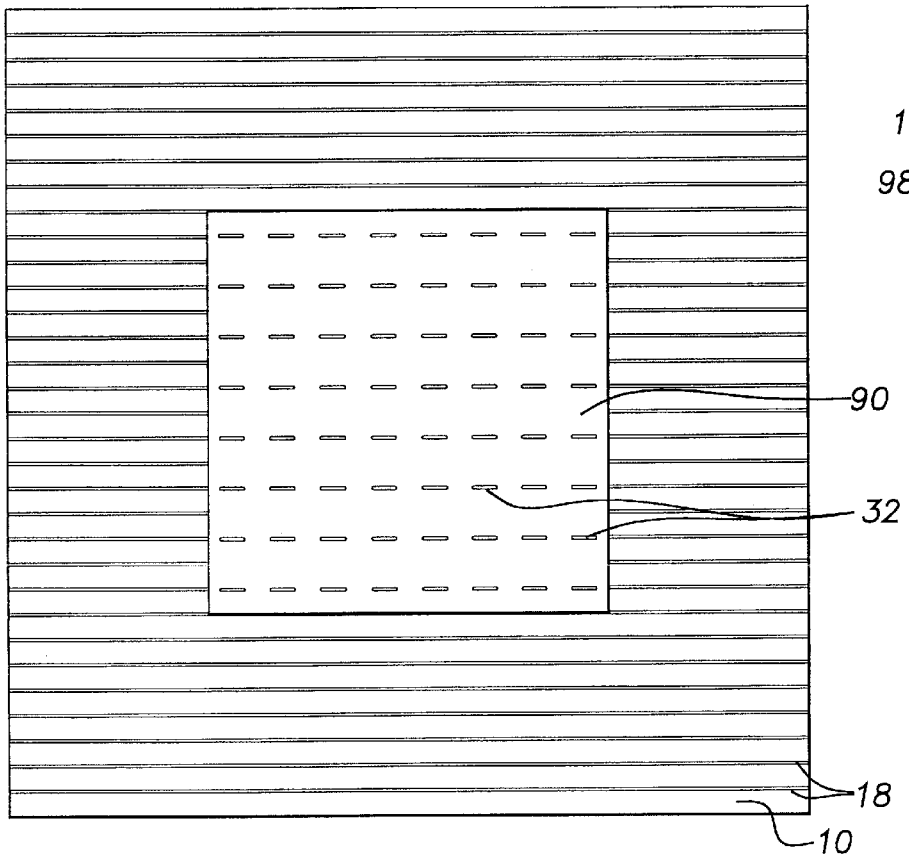
FIG. 14 is an elevational front view of a display panel mounted to the slatwall of FIG. 1 using a modified mounting support in accordance with the invention.

Referring to FIGS. 14 and 15, the display panel 90 is shown mounted to the slatwall 10 with a mounting bracket 92 and a cooperating spacing bracket 94. Display panel 90 is substantially identical with the display panel 70. Accordingly, the display panel 90 has a 4' by 4' modular size and includes slots 32 arranged in an 8 row by 8 column array. The slots 32 may be arranged in other patterns. A kerf 42 is cut in the rear face 96 of the panel 90 for engagement with the bracket 92 as described below.

The brackets 92 and 94 are sized to extend along a substantial portion of the width of the display panel in the same manner as the mounting rail 34. However, the brackets 92 and 94 provide an increased spacing between the slatwall 10 and the display panel 90, e.g., 2 to 5 inches. The brackets 92 and 94 provide a 3 inch spacing. The increased spacing provides a greater depth of design appearance and is aesthetically more pleasing for certain product display and/or decorative arrangements.

The brackets 92 and 94 may be sized in accordance with the dimensions of the display panel. In the case of a 4' by 4' display panel size, the brackets are provided with a length of about 40 inches and depth of about three inches.

The brackets may be formed of any material of sufficient strength and rigidity. For example, 18 gauge sheet steel may be used and the brackets may be formed using rolling and bending processes. The brackets may be provided with a suitable architectural interior finish. For example, the surfaces may be anodized, powder coated, painted or finished in some other aesthetically pleasing manner.

Figure 16:
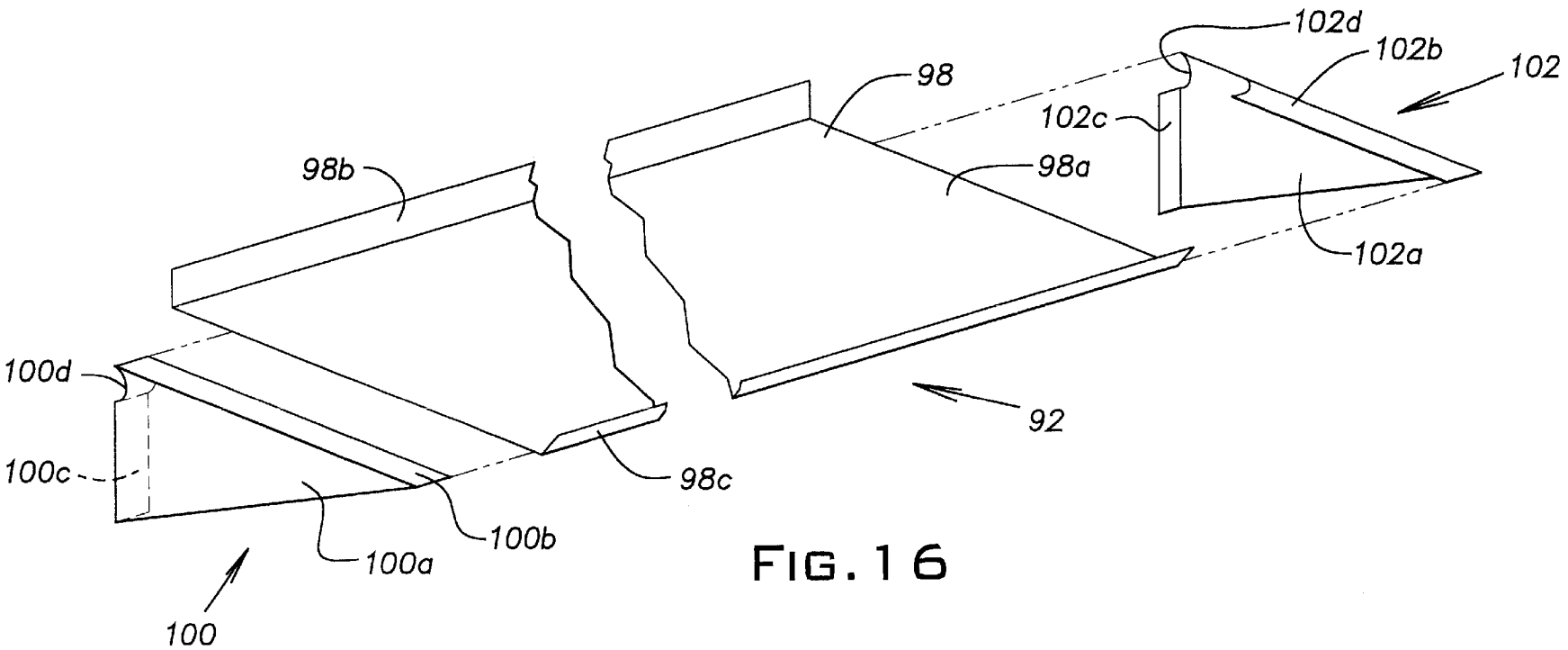
FIG. 16 is an exploded perspective view on an enlarged scale of the mounting shelf used to mount the display panel in FIG. 15.

As best shown in FIG. 16, the bracket 92 comprises a support shelf 98 connected to opposed end gussets 100 and 102. Gussets 100 and 102 are mirror images and may be connected to the shelf 98 by any convenient means such as spot welding.

The support shelf 98 has a generally planar central portion 98*a*. A supporting leg portion 98*b* projects at a right angle from the planar portion 98*a* along rear edge thereof. An engagement portion 98*c* extends at about a 45 degree angle from the planar portion 98*a* along the front edge thereof.

The gussets 100 and 102 are of triangular configuration. The gussets 100 and 102 respectively include support members 100*a* and 102*a*, shelf engagement members 100*b* and 102*b* and slatwall engaging members 100*c* and 102*c*. The gussets include notches 100*d* and 102*d* formed in the adjacent members 100*a*, 100*c* and 102*a*, 102*c* at the upper corners of the gussets. Each of the gussets may be formed from a single piece of sheet steel that is bent to form the shelf and slatwall engaging members.

The gussets 100 and 102 are dimensioned and assembled so as to be spaced forward of the plane of the supporting leg portion 98*b* of the support shelf 98. As best shown in FIG. 15, this spacing corresponds with the thickness of the front wall 18*a* of the groove 18 in the slatwall 10.

The spacing bracket 94 is constructed in substantially the same manner as the mounting bracket 92. Accordingly, the bracket 94 includes a support shelf 104 connected to a second pair of opposed gussets 100 and 102.

The support shelf 104 has a planar portion 104a connected to a generally perpendicularly extending supporting leg portion 104*b*. An engagement portion 104*c* may also extend at a right angle from the planar portion 104*a* to provide a suitable surface for engaging the rear face 96 of the display panel 90.

Referring to FIG. 15, the bracket 92 is mounted to the slatwall 10 by inserting the supporting leg portion 98*b* through the throat 18*b* and upwardly into the groove 18 with bracket rotation in a clockwise direction. When fully inserted in the groove and moved to its fully mounted position, the supporting leg portion 98*b* engages the rear face of the front wall 18*a* of the groove 18, a lower edge of the throat 18*b* engages the adjacent lower surface of the support shelf 98*a* and the slatwall engaging members 100*c* and 102*c* of the gussets engage the front face 12 of the slatwall 10. In this position, the support shelf 98 extends at a right angle from the front face 12 of the slatwall 10 for insertion of the engagement portion 98*c* into the kerf 42.

The bracket 94 is mounted in its associated groove 18 in the same manner as described above with respect to the bracket 92. When fully mounted, the support shelf 104 extends at a right angle from the front face 12 of the slatwall 10 and the slatwall engagement portion 104*c* is positioned in a vertical plane to assure proper spacing and orientation of the display panel 90.

As shown in FIG. 15, if a liner is used in the groove 18, the notches 90*d* will accommodate or provide clearance for the lower lip of the liner. The notches 90*d* may be provided with a suitable shape to assure such clearance in the same manner as the bight 34*a* of the rail 34 as shown in FIG. 8.

Accordingly, the display panel 90 is supported in a vertical plane by the portion 98*c* of the bracket 92 and the stable maintenance of this orientation is assured by the engagement portion 104*c* working against the rear face 96 of the display panel 90.

Referring to FIGS. 17, 18 and 19, a wire grid wall 110 is shown having a mounting bracket assembly 112 for mounting the display panel 90 to the grid wall. The bracket assembly 112 may be used to mount any of the illustrated display panels herein since it employs a common kerf engagement portion as described below.

The grid wall 110 is commercially available for use in connection with the display of merchandise, and it is typically supported by a structural wall (not shown) or the like. The grid wall is formed of horizontal wires 110*a* and vertical wires 110*b*. The wires are rigid and may be formed of steel rod having a ⅛ inch or ¼ inch diameter. The wires are connected at crossover points by any convenient means such as welding. The wire pattern may be arranged on 3 inch centers as shown, or in other sizes, and provided with a suitable display finish such as painting or powder coating.

The bracket assembly 112 includes a pair of spaced brackets 114 connected by a mounting hook 116. The bracket 114 is about 1 inch wide and provides a stable strap-like hanger. The hook 116 is about 18 inches long and it is connected to the brackets 114 by spot welding. Other dimensions may be employed in accordance with the sizes of the grid wall pattern and display panel to be mounted thereon.

The bracket 114 has a rearwardly opening C-shape including a vertically extending bight portion 114*a*, a downwardly opening hook portion 114*b* at its upper end and a lower foot 114*c* at its lower end. The bracket 114 is nominally 3 inches in length and sized to engage adjacent upper and lower wires 110*a*. The hook portion 114*b* is sized to fit over an upper wire 100*a* of the grid wall 110 and the foot 114*c* is adapted to engage the grid wall 110 just below the lower surface of the adjacent lower wire 110*a*. The bight portion 114*a* is sized so that the hook portion 114*b* and lower foot 114*c* engage adjacent wires 110*a*.

The hook portion 116 has a J-shape including a planar mounting portion 116*a* and an engagement portion 116*b*. The planar portion 116*a* is about 1½ inches tall and may be spot welded to the bight portion 114*a* of the bracket. The engagement portion 116*b* projects angularly upwardly from a lower extremity of the planar portion 116*a*. The engagement portion 116*b* may project at an angle of about 45 degrees and have a length of about ⅜ of an inch.

The bracket 114 and hook 116 may be formed of 18 gauge sheet steel and secured together by spot welding. Further, the bracket assembly 112 may be provided with a suitable architectural interior finish as described above.

As shown in FIG. 19, the display panel 90 may be mounted to the grid wall 110 by the bracket assembly 112. To that end, the engagement portion 116*b* is received in the kerf 42 in the rear face 96 of the display panel 90. The display panel 90 will be mounted in substantially a vertical plane adjacent the grid wall 110 without the use of lower bumpers as described in prior embodiments. There is no need to use such bumpers since the bracket assembly 112 has a total thickness of about 0.1 inches.

While particular embodiments of the present invention have been illustrated and described herein, it is not intended to limit the invention and changes and modifications may be made therein within the scope of the following claims.

What is claimed:

1. A merchandise display system comprising a slatwall having a slatwall area, a display panel having a panel area smaller than said slatwall area and a mounting rail securing said panel to said slatwall, said slatwall including a back slatwall face for attachment to a support structure and a front slatwall face having a plurality of horizontally extending grooves for mounting merchandise, said mounting rail having first and second mounting legs extending in opposite transverse directions from a support leg, said first and second legs being engagable with said groove and slatwall so that said support leg projects from said front slatwall face, said panel having a back panel face and a front panel face, said back panel face including panel mounting means for engaging said support leg and mounting said display panel to said slatwall with said front panel face extending over at least a portion of said front slatwall face.

2. A display system as set forth in claim 1, wherein said mounting rail has a Y-shape and is disposed in a horizontal or laying-over position with said first leg extending into said groove, said second leg extending against said front slatwall face and said support leg projecting from said front slatwall face to support said display panel.

3. A display system as set forth in claim 1, wherein said front panel face includes product support means for engaging and disengaging support hardware.

4. A display system as set forth in claim 3, wherein said display panel has a maximum product support weight, and said mounting rail supports said panel with a strength exceeding said maximum product support weight.

5. A display system as set forth in claim 4, wherein said display panel has a panel length and said rail has a rail length, and said rail length is equal at least about 80% of said panel length.

6. A display system as set forth in claim 3, wherein said product support means include a slot having a throat open to said front panel face for engaging and disengaging said support hardware including wire-formed.

7. A display system as set forth in claim 6, wherein said slot includes a recess communicating with said throat and open to said back panel face.

8. A display system as set forth in claim 7, wherein said throat has a throat cross-sectional area and said recess has a recess cross-sectional area, and said recess cross-sectional area is larger than said throat cross-sectional area.

9. A display system as set forth in claim 1, wherein said display panel and said slatwall are each provided in modular form, and said modular display panel has an area at least equal to ⅛ of the area of said modular slatwall.

10. A display system as set forth in claim 2, wherein at least one of said grooves includes a front groove wall having a groove wall thickness, said first leg extends into said at least one groove and engages a rear face of said front groove wall, and said first and second legs are spaced apart a horizontal offset distance substantially equal to said groove wall thickness.

11. A display system as set forth in claim 10, wherein said front wall thickness and horizontal offer distance vary so as to cause said support leg of said mounting rail to be displaced from said horizontal or laying-over position prior to mounting said panel on the mounting rail, said display panel includes spacer means extending from said rear panel face to engage said front wall face and, upon supporting said panel on said rail, the panel weight cooperates with said spacer means to return said support leg to said horizontal or laying-over position.

12. A display system as set forth in claim 11, wherein said panel deflects said rail to move said support leg to said horizontal or laying-over position.

13. A merchandise display system comprising a display panel removably supported by a mounting rail to a fixed support structure having a mounting groove, said display panel having a front panel face including product support means for displaying merchandise and a rear panel face including mounting means for engaging said mounting rail, said mounting rail having first and second mounting legs extending in opposite transverse directions from a support leg, said mounting rail having an upper mounting element engaged within said mounting groove, a lower mounting element positioned against said fixed support structure and a projecting support element engaging said panel rear face to mount said display panel in a substantially vertical plane.

14. A display system as set forth in claim 13, wherein said display panel includes spacer means extending from said rear panel face to engage an adjacent supporting surface with said front panel face in said vertical plane, and, upon supporting said panel on said rail, the panel weight cooperates with said spacer means to maintain said support leg in said substantially vertical plane.

15. A display system as set forth in claim 13, wherein said product support means comprise slot means including a slot open to said front panel face, said slot communicating with a recess open to said back panel face.

16. A display system as set forth in claim 13, wherein said product support means include a throat open to said front panel face for engaging and disengaging product support hardware.

17. A merchandise display system comprising a display panel removably supported by a mounting rail to a fixed support structure, said display panel having a front panel face including product support means for displaying merchandise and a rear panel face including mounting means for engaging said mounting rail, said mounting rail having first and second mounting legs extending in opposite transverse directions from a support leg, said first and second legs being engagable with said fixed support structure so that said support leg projects in a substantially horizontal direction to engage said mounting means and support said panel front face in a substantially vertical plane, said product support means comprising slot means including a horizontally extending slot open to said front panel face and communicating with a recess open to said back panel face, and a vertically extending slot intersecting said horizontally extending slot to accommodate product supports.

18. A mounting rail for supporting a display panel in a support wall having a mounting groove, said mounting rail having first and second mounting legs extending in opposite transverse directions from a support leg, said rail having a Y-shape and being disposed in a horizontal or laying-over position with said first leg extending into said mounting groove, said second leg extending against said support wall and said support leg projecting from said support wall to support said panel, said display panel having a front panel face including product support means for displaying merchandise and a rear panel face including panel mounting means for engaging said mounting rail and supporting said panel with said front panel face extending in a substantially vertical plane.

19. A mounting rail as set forth in claim 18, wherein said panel has a panel length and said rail has a rail length, and said rail length is equal to at least about 80% of said panel length.

20. A merchandise display system comprising a slatwall adapted to be mounted to a building support structure and having a slatwall front face including a plurality of horizontally extending grooves for mounting merchandise and a slatwall back face for attachment to said building support structure, a display panel having a panel front face including a plurality of slots and a panel back face, and panel support means for mounting said display panel to said slatwall, said panel support means including an upper mounting element engaged within one of said grooves, a lower element positioned against said slatwall front face and a projecting support element including an engagement portion adapted to be connected to said panel back face to mount said display panel to said slatwall in spaced relationship.

21. A merchandise display system as set forth in claim 20, wherein said panel support means comprises a mounting rail having first and second mounting legs extending in opposite transverse directions from a support leg, said first leg forming said upper element, said second leg forming said lower element and said support leg forming said support element.

22. A merchandise display system as set forth in claim 21, wherein said mounting rail has a Y-shape cross-section and each of said legs has an elongate flat shape.

23. A merchandise display system as set forth in claim 22, wherein said engagement portion comprises an angular extension of said support leg adapted to be connected to said display panel.

24. A merchandise display system as set forth in claim 23, wherein said panel back face has a kerf cut therein, and said angular extension is engaged within said kerf.

25. A merchandise display system as set forth in claim 20, wherein said panel support means comprises a bracket assembly including a shelf having a planar portion extending between support gussets, said upper mounting element comprising a leg extending at a right angle from a rear edge of said planar portion for engagement in one of said grooves, said support element comprising an engagement portion angularly extending from a front edge of said planar portion, and said lower element comprising said gussets mounted at opposite ends of said shelf with each gusset engaging an adjacent lower surface of said shelf and an adjacent surface of said slatwall front face.

26. A merchandise display system as set forth in claim 20, wherein at least one of said slots has a throat open to said front panel face for engaging and disengaging said support hardware including wire-formed hardware for product display.

27. A merchandise display system as set forth in claim 26, wherein said slot includes a recess communicating with said throat and open to said back panel face.

28. A merchandise display system as set forth in claim 27, wherein said throat has a throat cross-sectional area and said recess has a recess cross-sectional area, and said recess cross-sectional area is larger than said throat cross-sectional area.

29. A merchandise display system as set forth in claim 20, including a second display panel having a second panel front face including a second plurality of slots and a second panel back face, and a second panel support means for mounting said second display panel to said first mentioned display panel, said second panel support means including a second engagement portion adapted to be connected to said second panel back face to mount said second display panel to said first mentioned display panel in spaced relationship.

30. A merchandise display system as set forth in claim 29, wherein said slots are horizontally extending grooves.

31. A merchandise display system comprising a first wall adapted to be mounted to a building support structure and having a first front face including first merchandise display means, a second wall having a second front face including second merchandise display means, and first wall support means for mounting said second wall to said first wall, said first wall support means securing said second wall to said first merchandise support means to mount said walls in spaced and substantially parallel relationship, said first merchandise display means comprising a plurality of first wall openings in said first front face for removably receiving and engaging product support hardware and said first wall support means, said first wall support means comprising a mounting rail having first and second mounting legs extending in opposite transverse directions from a support leg, said first leg being received within one of said first wall openings and said second leg being positioned against said first front face so that said support leg projects from said first front face toward said second wall, said support leg includes an engagement portion adapted to be connected to said second wall, said second wall includes a second rear face having a kerf cut therein, and said engagement portion is engaged within said kerf.

32. A merchandise display system as set forth in claim 31, wherein said first wall comprises a slatwall having a plurality of horizontally extending grooves providing said first wall openings and said second wall comprises a display panel having a plurality of slots.

33. A merchandise display system comprising a first wall adapted to be mounted to a building support structure and having a first front face including first merchandise display means, a second wall having a second front face including second merchandise display means, and first wall support means for mounting said second wall to said first wall, said first wall support means securing said second wall to said first merchandise support means to mount said walls in spaced and substantially parallel relationship, said first merchandise display means comprises a plurality of first wall openings in said first front face for removably receiving and engaging product support hardware and said first support means, said support means comprises a bracket assembly including a shelf having a planar portion extending between support gussets, said shelf including a leg extending at a right angle from a rear edge of said planar portion into one of said first openings and an engagement portion angularly extending from a front edge of said planar portion, said gussets being mounted at opposite ends of said shelf with each gusset engaging an adjacent lower surface of said shelf and an adjacent surface of said first front face.

34. A merchandise display system as set forth in claim 33, wherein said first wall comprises a slatwall having a plurality of horizontally extending grooves providing said first wall openings and said second wall comprises a display panel having a plurality of slots.

35. A merchandise display system comprising a first wall adapted to be mounted to a building support structure and having a first front face including first merchandise display means, a second wall having a second front face including second merchandise display means, and first wall support means for mounting said second wall to said first wall, said first wall support means securing said second wall to said first merchandise support means to mount said walls in spaced and substantially parallel relationship, said first merchandise display means comprising a plurality of first wall openings in said first front face for removably receiving and engaging product support hardware and said first support means, said first wall support means comprising a bracket assembly including an elongate hook having a bracket at each end thereof mounted to said first wall, each of said brackets having a bracket hook portion and a lower foot for engagement with associated ones of said first wall openings, said elongate hook including an engagement member angularly extending toward said second wall for engagement therewith.

36. A merchandise display system as set forth in claim 35, wherein said first wall comprises a wire grid wall having horizontal and vertical wires arranged in a grid pattern to provide said first wall openings and said second wall comprises a display panel having second wall openings comprising a plurality of slots providing said second wall openings.

37. A merchandise display system comprising a first wall adapted to be mounted to a building support structure and having a first front face including first merchandise display means, a second wall having a second front face including second merchandise display means, and first wall support means for mounting said second wall to said first wall, said first wall support means securing said second wall to said first merchandise support means to mount said walls in spaced and substantially parallel relationship, said first merchandise display means comprises a plurality of first wall openings in said first front face for removably receiving and engaging product support hardware and said first support means, further including a third wall having a third front face including third merchandise display means, and a second wall support means for mounting said third wall to said second wall, said second wall support means securing said third wall to said second merchandise support means to mount said second and third walls in spaced and substantially parallel relationship.

38. A merchandise display system as set forth in claim 37, wherein said second merchandise display means comprises a plurality of second wall openings in said second front face for removably receiving and engaging product support hardware and said second support means.

39. A merchandise display system as set forth in claim 38, wherein said first wall comprises a slatwall having a plurality of horizontally extending grooves providing said first wall openings, said second wall comprises a first display panel having a plurality of first slots providing said second wall openings, and said third wall comprises a second display panel having a plurality of second slots providing said third wall openings.

* * * * *

UNITED STATES PATENT AND TRADEMARK OFFICE

CERTIFICATE OF CORRECTION

PATENT NO. : 6,491,172 B2
DATED : December 10, 2002
INVENTOR(S) : Kenneth R. Chance et al.

It is certified that error appears in the above-identified patent and that said Letters Patent is hereby corrected as shown below:

Column 10,
Line 53, after "wire-formed" insert -- hardware for product display --.

Signed and Sealed this

Seventeenth Day of June, 2003

JAMES E. ROGAN
*Director of the United States Patent and Trademark Office*